US006878869B2

(12) United States Patent
Mita et al.

(10) Patent No.: US 6,878,869 B2
(45) Date of Patent: Apr. 12, 2005

(54) AUDIO SIGNAL OUTPUTTING METHOD AND BGM GENERATION METHOD

(75) Inventors: Tohru Mita, Urayasu (JP); Koji Kaifu, Tokyo (JP)

(73) Assignee: Sega Corporation, Tokyo (JP)

( * ) Notice: Subject to any disclaimer, the term of this patent is extended or adjusted under 35 U.S.C. 154(b) by 0 days.

(21) Appl. No.: 10/050,548

(22) Filed: Jan. 18, 2002

(65) Prior Publication Data

US 2002/0117045 A1 Aug. 29, 2002

(30) Foreign Application Priority Data

Jan. 22, 2001 (JP) ..... 2001-012637

(51) Int. Cl.[7] ..... G63H 5/00; G04B 13/00; G10H 7/00

(52) U.S. Cl. ..... 84/609; 84/610; 84/615; 84/649; 84/650; 84/653

(58) Field of Search ..... 84/600–602, 609–612, 84/615, 618, 622–625, 649–653, 656, 659–660

(56) References Cited

U.S. PATENT DOCUMENTS 5,095,798 A * 3/1992 Okada et al. ..... 84/609
5,399,799 A * 3/1995 Gabriel ..... 84/609
5,627,335 A * 5/1997 Rigopulos et al. ..... 84/635
5,763,804 A * 6/1998 Rigopulos et al. ..... 84/635
5,767,430 A * 6/1998 Yamanoue et al. ..... 84/602
5,789,690 A * 8/1998 Furuhashi et al. ..... 84/633
6,031,174 A * 2/2000 Takabayashi ..... 84/609
6,225,547 B1 * 5/2001 Toyama et al. ..... 84/611
6,342,665 B1 * 1/2002 Okita et al. ..... 84/609
6,410,835 B2 * 6/2002 Suzuki et al. ..... 84/464 R

FOREIGN PATENT DOCUMENTS

EP 0 729 131 A2 8/1996
EP 0 823 270 A2 2/1998
EP 1 041 536 A1 11/1998

* cited by examiner

*Primary Examiner*—Marlon T. Fletcher
(74) *Attorney, Agent, or Firm*—Finnegan, Henderson, Farabow, Garrett & Dunner, L.L.P.

(57) ABSTRACT

A game device is provided which has a function to automatically compose background music without forcing a player to input complicated operations, while allowing the player to enjoy the game. A game processor (22) receives operational signals from a control pad (10) and thereby performs the game processing. An accompaniment parameter generator (25) receives, from the game processor (22), parameters relating to the status of the game and then generates an accompaniment parameter which corresponds to the status of the game. A melody parameter generator (24) receives the operational signals from the control pad (10), and then decides on scales, sound production starting time, note lengths and other necessary conditions by considering the operational signals as sound producing factors for a melody. The starting time for producing the melody is determined by referring to the sound producing timing of the melody which is included in the accompaniment parameter. A sound processor (26) reproduces the background music which is specified by the accompaniment parameter and the melody parameter.

12 Claims, 8 Drawing Sheets

20 GAME DEVICE
CONTROL PAD
10
CD-ROM DRIVE
21
GAME PROCESSOR
22
MELODY PARAMETER GENERATOR
24
ACCOMPANIMENT PARAMETER GENERATOR
25
SOUND PRODUCING TIMING ADJUSTER
27
BUFFER MEMORY
28
SOUND PROCESSOR
26
IMAGE DISPLAY PROCESSOR
23
30 TV MONITOR
41
42
50

GENERATION OF MELODY PARAMETER

| SOUND PRODUCING FACTOR | SOUND PRODUCING PROCESSING UNIT |
|---|---|
| KEY INPUT (BUTTON A) | 1/8 NOTE UNIT |
| KEY INPUT (BUTTON B) | 1/8 NOTE UNIT |
| KEY INPUT (BUTTON X) | 1/4 NOTE UNIT |
| KEY INPUT (BUTTON Y) | 1/4 NOTE UNIT |

| SOUND PRODUCING FACTORS | SOUND PRODUCING PROCESSING UNIT |
|---|---|
| KEY INPUT (BUTTON A) | 1/8 NOTE UNIT |
| KEY INPUT (BUTTON B) | 1/8 NOTE UNIT |
| EXPLOSION A PROCESSING | 1/16 NOTE UNIT |
| EXPLOSION A PROCESSING | 1/16 NOTE UNIT |

AUDIO SIGNAL OUTPUTTING METHOD AND BGM GENERATION METHOD

BACKGROUND OF THE INVENTION

1. Field of the Invention

The present invention relates to a technique for adjusting a starting timing for producing sounds which include sound effects, voices such as the speaking of lines of dialogue, and music such as background music (BGM). More particularly, this invention relates to an improved technique enabling the production of sounds of an appropriate musical timing by a simple operation without forcing a player to input complicated operations.

2. Description of the Related Art

Conventional game devices display animations on screens and also output BGM corresponding to scenes in order to enhance the realistic felling of the game. For example, in a virtual game space composed of three-dimensional coordinates and structured by placing various kinds of objects and virtual human beings therein, a game proceeds as a main character of the game freely moves in the game space, while music is output as BGM in accordance with the relevant scenes. In a vehicle competition game, the game is designed to generate sounds of engines, slipping sounds, collisions and so on in accordance with the progress of the game. Accordingly, a program to develop a game story is stored in advance with images to be displayed as the game progresses and output patterns of audio signals such as music, voices, and sound effects which correspond to the images.

The BGM outputted by the conventional game device is stored in advance in a game program and the game program is designed to change the BGM to be outputted according to the progress of the game. In this case, however, the BGM to be outputted is simply switched depending on the game scenes and other conditions, and the conventional game does reflect input operations of a controller made by a player (a game player or music player) during the game in the generation of the BGM.

Moreover, the sound effects such as explosions in the processing of the game, are output on a previously set timing in order to synchronize with the displayed images such as an image of an explosion. Concerning an interactive game in which the flow of information is not only in one direction, it has been impossible to control the timing of outputting the sound effects in accordance with other timings in order to enable rhythmical operations by the players.

If BGM can be automatically generated in response to the progress of the game and the player's input operations, it is possible to enhance a sense of unity between the player and the BGM to make the player feel as if he/she is playing the music while playing the game. What is important is not to put an excessive burden on the player by forcing them to concentrate on the generation of BGM. If the player is required to handle complicated input operations and input timings for the generation of BGM, the required performance is practically as difficult as playing a normal musical instrument. Therefore, the player cannot easily enjoy generating the BGM, while enjoying the game itself.

It is an object of the present invention to provide a BGM generation technique which enables the player to easily compose the BGM without the requirement of any complicated input operations. Moreover, it is another object of this invention to suggest a technique of adjusting the output timing of the audio signals such as sound effects to an appropriate musical timing in order to implement a harmonious sound environment.

SUMMARY OF THE INVENTION

In order to solve the above-described problems, this invention detects a sound producing factor, which is a cause of audio production, and decides on a starting timing for producing the sound, which corresponds to the sound producing factor, on the basis of the progress of the music which is being reproduced at the time of generation of the sound producing factor. Accordingly, the sounds such as the sound effects are processed to be produced in synchronization with the progress of the music such as BGM, thereby providing a harmonious sound environment.

This invention also generates accompaniment corresponding to the status of a game, detects a sound producing factor which is a cause of melody generation, and generates a melody by deciding on a starting timing for producing the melody, which corresponds to the sound producing factor, on the basis of the progress of the accompaniment at the time of generation of the sound producing factor. Accordingly, the accompaniment is automatically generated in accordance with the status of the game, thereby enabling the player to compose BGM according to the status of the game without any complicated operations.

Moreover, according to this invention, it is possible to provide a computer-readable recording medium having a program stored thereon for causing a computer system to executing the above-described method. Examples of such a computer readable storage medium include optical storage media (storage media capable of optically reading data, such as CD-ROMs, DVD-ROMs, DVD-RAMs, DVD-Rs, PD disks, MD disks and MO disks), magnetic storage media (storage media capable of magnetically reading data, such as flexible disks, magnetic cards and magnetic tapes), and portable storage media such as memory cartridges including storage elements such as semiconductor memories (such as DRAM) or optical memories, as well as inner storage devices, which are provided inside a computer or on a memory card, and external storage devices such as hard disks.

DESCRIPTION OF THE PREFERRED EMBODIMENTS

An embodiment of the present invention is hereinafter explained with reference to the attached drawings.

Figure 1:
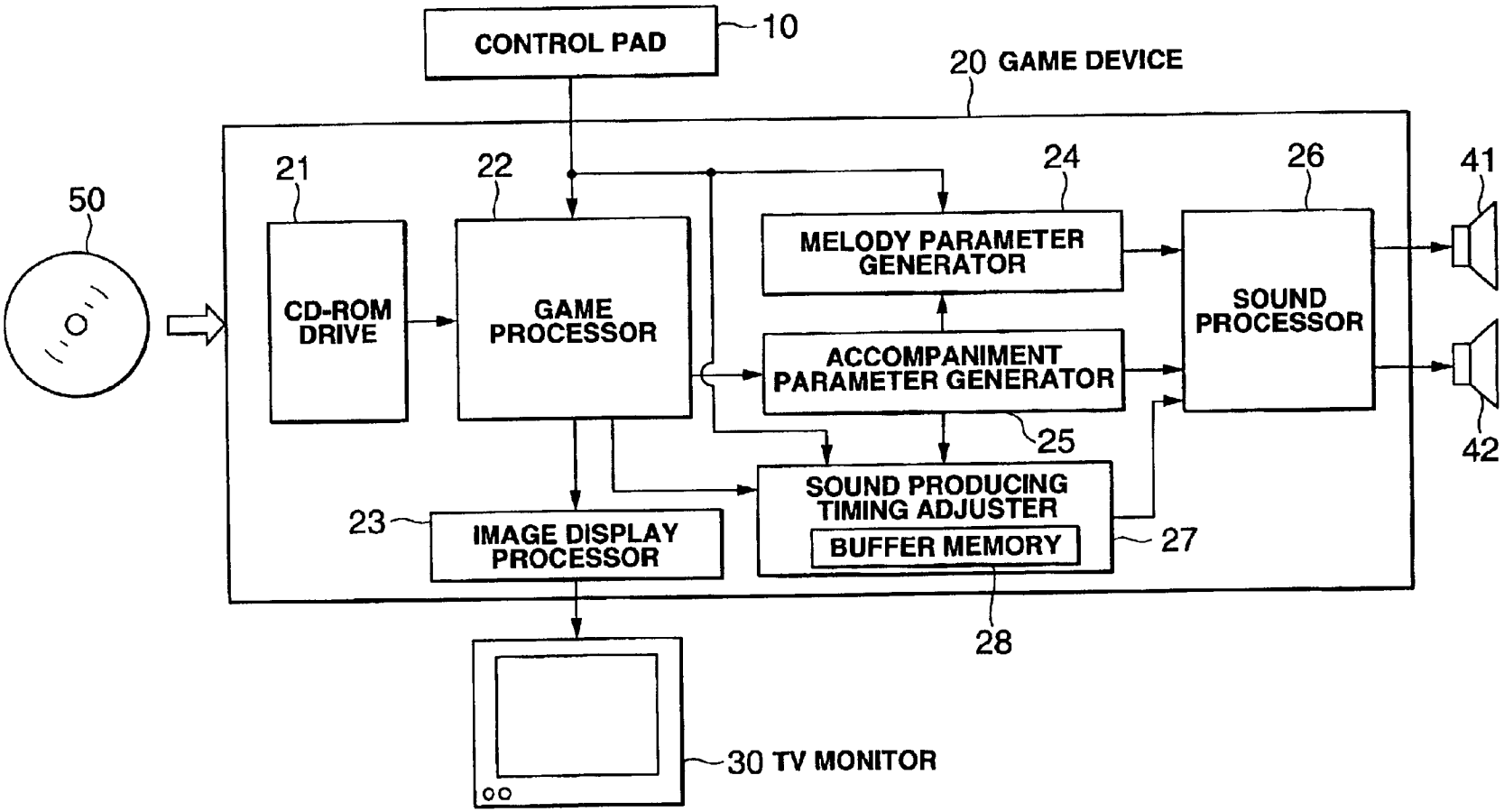
FIG. 1 is a functional block diagram of the game device having a function to compose BGM according to the present invention.

FIG. 1 functional block diagram of a game device which includes a BGM generating function. As shown in FIG. 1, a game device 20 comprises: a CD-ROM drive 21; a game processor 22; an image display processor 23; a melody parameter generator 24; an accompaniment parameter generator 25; a sound processor 26; and a sound producing timing adjuster 27. The game processor 22 is structured with various kinds of hardware such as a CPU, RAM and ROM that are necessary for the game processing. The game processor 22 reads and performs a game program supplied from a CD-ROM 50 via the CD-ROM drive 21.

The image display processor 23 includes a frame buffer, a color RAM, an encoder, and the like. The image display processor 23 displays an object which is to be displayed on a TV monitor 30 with polygons (a three-dimensional figure composed of vertexes and ridge lines defined in a model coordinate system) on the basis of command data supplied from the game processor 22, and performs object modeling conversion to a world coordinate system, visual field conversion to a specified camera visual point, three-dimensional clipping processing, hidden-line elimination processing, texture mapping processing, shading processing, display priority processing, and other necessary processing, and then displays the object on the TV monitor 30.

The accompaniment parameter generator 25 is a module which is realized by an accompaniment parameter generation program. The accompaniment parameter generator 25 selects an appropriate accompaniment element from previously registered accompaniment elements, on the basis of a game parameter supplied from the game processor 22, thereby generating an accompaniment parameter. The accompaniment elements are various musical elements constituting an accompaniment part, which include tempos, keys, chords, rhythm patterns, accompaniment patterns, types of effects, and performances of the effects. The accompaniment parameter is information about a combination of the accompaniment elements constituting the accompaniment part that is actually reproduced by the sound processor 26. The game parameter is the element causing changes to the accompaniment and is set in accordance with various game conditions such as scores the player attains, the speed of the progress of the game, the difference in power between the player's character and an enemy character, and the brightness of the game screen. The detailed procedure of the generation of the accompaniment parameter will be explained later.

The melody parameter generator 24 is a module which is realized by a melody parameter generation program, and it generates a melody parameter on the basis of operational information of the player, which is input with a controller 10, and also on the basis of the accompaniment parameter which is output from the accompaniment parameter generator 25. The melody parameter is a parameter for regulating scales of notes constituting the melody, the starting timing for producing notes, lengths of the notes, and other conditions. The operational information input by the player with the controller 10, contains information about whether a switch button is pressed or released, and whether a lever is pulled down or turned, and information to tell that voices are input from a microphone. The detailed procedure of the generation of the melody parameter will be explained later.

The sound processor 26 comprises, for example, a sound CPU, a sound memory, and a D/A converter. The sound processor 26 composes BGM on the basis of a sound producing request made by the melody parameter generator 24 and the accompaniment parameter generator 25, and then reproduces the melody and accompaniment. The sound memory stores previously registered sound data (such as MIDI data) which corresponds to the melody parameter and the accompaniment parameter. The sound CPU implements, on the timing designated by the melody parameter and the accompaniment parameter, special sound effects such as echoes, reverbs, and choruses based on a DSP function, and it outputs the audio signals to speakers 41 and 42. The output timing of the audio signals such as the melodies and the sound effects that are to be produced by the sound processor 26, is adjusted by the sound producing timing adjuster 27.

Figure 2:
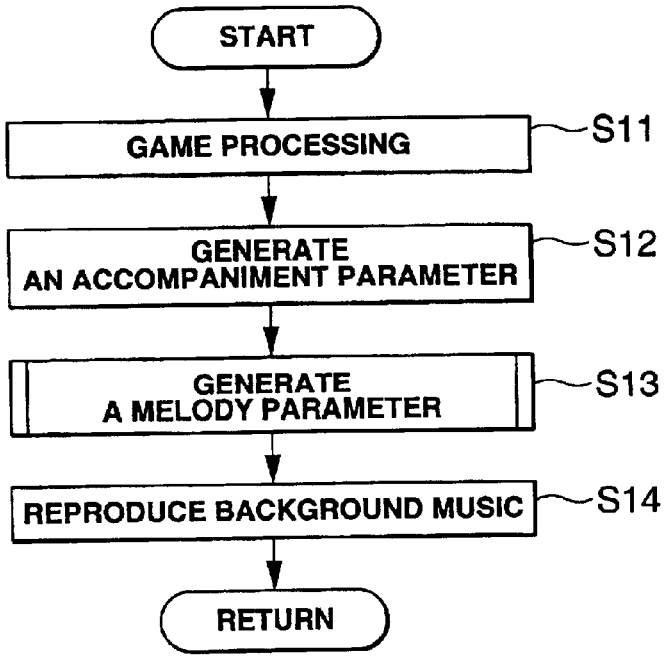
FIG. 2 is a flow chart showing the entire flow of the operation of the game device.

FIG. 2 is a flow chart indicating the automatic music generating steps performed by the game device 20. Each processing step shown in FIG. 2 is repeatedly executed in synchronization with an image renewal period (for example, one-sixtieth (1/60) of a second). As shown in the flow chart, the automatic music generating steps comprises: a game processing step (S11) conducted by the game processor 22; an accompaniment parameter generating step (S12) conducted by the accompaniment parameter generator 25; a melody parameter generating step (S13) conducted by the melody parameter generator 24; and a BGM reproduction processing step (S14) conducted by the sound processor 26. Each processing step is hereinafter explained.

Game Processing Step (S11)

Figure 7:
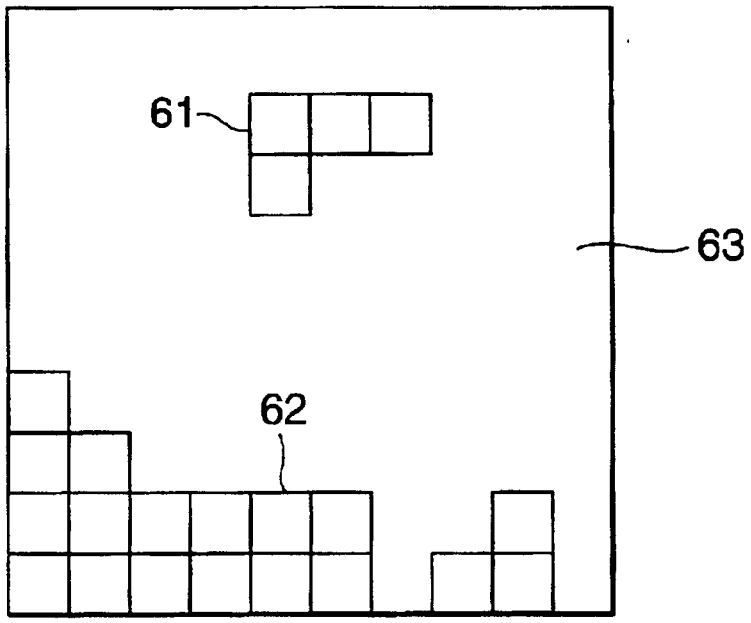
FIG. 7 shows a sample game screen.
Figure 9:
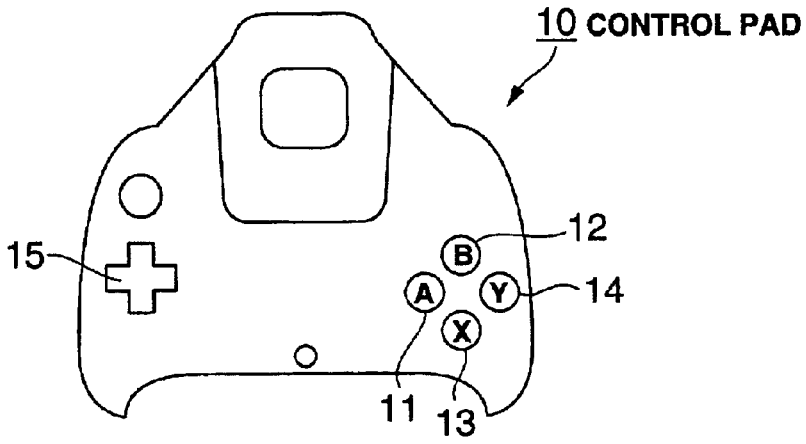
FIG. 9 is an external structural view of the control pad.

FIG. 7 shows a sample game screen. The content of the game is that a landing position and a landing state of an L-shaped moving block 61, which falls from the right top side of a virtual space 63 as shown in FIG. 7, are controlled by operating the controller 10, and when the depression and projection of the moving block 61 are matched with the depression and projection of accumulated blocks 62, a point is added. FIG. 9 is an external structural view of the controller 10. The controller 10 has a button A 11, a button B 12, a button X 13, a button Y 14, and a cross key 15 arranged thereon. The player moves the moving block 61 to the right or left by slanting the cross key 15 to the right or left, thereby controlling the landing position of the moving block 61. The player also turns the moving block 61 by operating, for example, the button A 11, thereby controlling the landing posture of the moving block 61.

Accompaniment Parameter Generating Step (S12)

When the accompaniment parameter generator 25 obtains the game parameter from the game processor 22, for example, the accompaniment parameter generator 25 generates the accompaniment parameter by conducting, for example, the following operations: selecting a major key if the game proceeds favorably for the player; selecting a minor key if the game proceeds unfavorably for the player; using many cheerful chords if something happens favorable to the player; lessening the chord changes if the game proceeds monotonously; speeding up the tempo of the accompaniment if the player frequently operates the controller 10; slowing down the tempo at the end of a series of scenes; selecting a complicated performance pattern in a scene requiring the player to conduct complicated operations.

In role-playing games or competition games, for example, the accompaniment parameter generator 25 generates the accompaniment parameter by conducting, for example, the following operations: selecting a cheerful accompaniment pattern if the player's character enters a bright stage; selecting a somber accompaniment pattern if the player's character enters a dark stage; selecting an accompaniment pattern which sounds tense if the player's character is surrounded by enemy characters; selecting an accompaniment pattern which sounds rhythmical if the player's character escapes from the siege of the enemy characters; increasing the influence of the effects such as echoes if the player's character enters a narrow area; decreasing the influence of the effects such as echoes if the player's character enters a wide area; and changing the tempos, keys, chords, rhythm patterns and accompaniment patterns according to the movements of the player's characters, for example, when the player's character stands up, changes its moving direction, jumps, suffers damages, wins an item, moves violently, moves slowly, spins around, makes small movements, makes big movements, or falls down.

Performance patterns generated by the melody parameter generator 24, which will be explained later, may be used as the rhythm patterns or the accompaniment patterns. In this case, the performance patterns are stored in a memory and the performance patterns of frequent use are used at a certain rate. It is also possible to use existing musical compositions as the accompaniment.

Melody Parameter Generating Step (S13)

Figure 3:
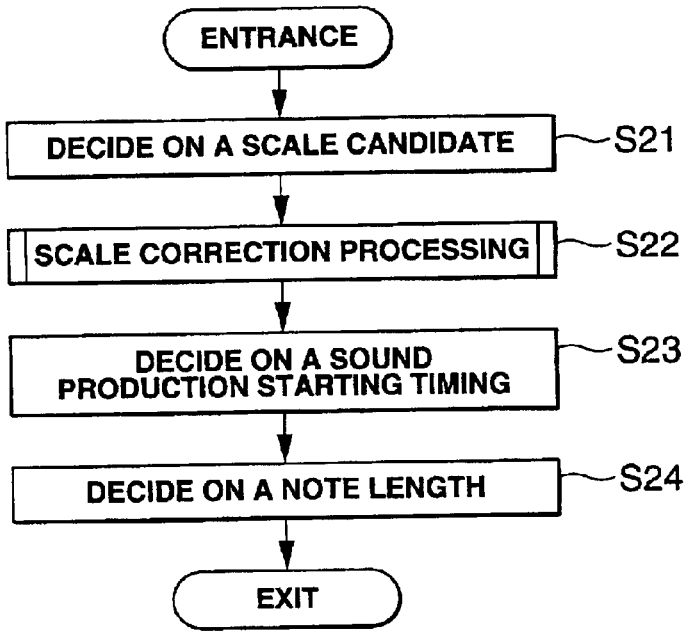
FIG. 3 is a flow chart describing a melody parameter generation subroutine.

When the melody parameter generator 24 receives the operational signals from the button A 11, the button B 12, the button X 13, the button Y 14, and the cross key 15 on the control pad 10, it then decides on a scale, a sound production starting time, and a note length, on the basis of information about, for example, the present tone and chord of the accompaniment parameter generated by the accompaniment parameter generator 25, and a time position in a musical composition. FIG. 3 shows a subroutine of the melody generating steps, which consists of a scale candidate deciding step (S21), a scale correction processing step (S22), a sound production starting time deciding step (S23) and a note length deciding step (S24). Each processing step will be explained in details below.

Scale Candidate Deciding Step (S21)

Figure 8:
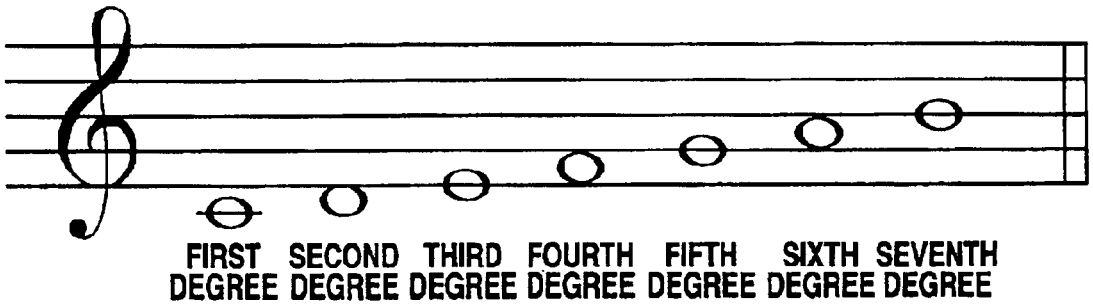
FIG. 8 is an explanatory drawing illustrative of scale values corresponding to the diatonic scale.

In this step, the melody parameter generator 24 monitors key operations made by the player with the control pad 10, in time with the synchronization of an image renewal period. When the melody parameter generator 24 detects a key operation, it decides on a scale candidate which corresponds to the key operation. As shown in FIG. 8, concerning the scale of tones of an accompaniment, numbers (scale value) are given to the tones in the ascending order from the lower scale. In the example of FIG. 8, the tones and their corresponding degrees are as follows: do (first degree), re (second degree), mi (third degree), fa (fourth degree), so (fifth degree), la (sixth degree) and ti (seventh degree). The scale shown in FIG. 8 is the diatonic scale. However, without limitation to such type of scale, the scale candidate is decided on basis of the scale of the accompaniment which is presently being reproduced.

As a method of deciding the scale candidate, there is a method of deciding it on the basis of a relative value and a method of deciding it on the basis of an absolute value. When deciding the scale candidate on the basis of a relative value, for example, the immediate preceding generated tone is set as a standard. The scale candidate is decided by conducting processing, for example, to lower the scale value one value if the cross key 15 is tilted to the right (or downward) to move the moving block 61 to the right (or downward), and to heighten the scale value one value if the cross key 15 is tilted to the left (or upward) to move the moving block 61 to the left (or upward). The scale candidate may also be decided by setting a positive numeric value to the button A 11 and a negative numeric value to the button B 12. Moreover, the scale candidate may be decided by setting a negative value if an analog key (not shown in the drawing) is turned to the right, and by setting a positive value if the analog key is turned to the left. Deciding the scale value on the basis of a relative value gives rise to such advantageous effects that a range of values in which the numeric value of the scale value can be decided does not have to be wide and that the continuity of a melody can be retained because the scale value will not deviate further from the previous scale.

When the scale candidate is decided on the basis of an absolute value, for example, the scale candidate is decided by assigning a scale value of the second degree to the button A 11, the third degree to the button B 12, the fifth degree to the button X 13, and the seventh degree to the button Y 14. As another example, such a structure may be employed that a virtual space 63 is divided into a plurality of regions, in each of which a degree of a scale value is set, thereby deciding the scale candidate corresponding to a region to which the moving block 61 has moved. Deciding the degree of the scale value on the basis of an absolute value gives rise to such an advantageous effect that the player can enjoy controlling the music as if he/she is playing a real musical instrument.

Scale Correction Processing Step (S22)

Figure 4:
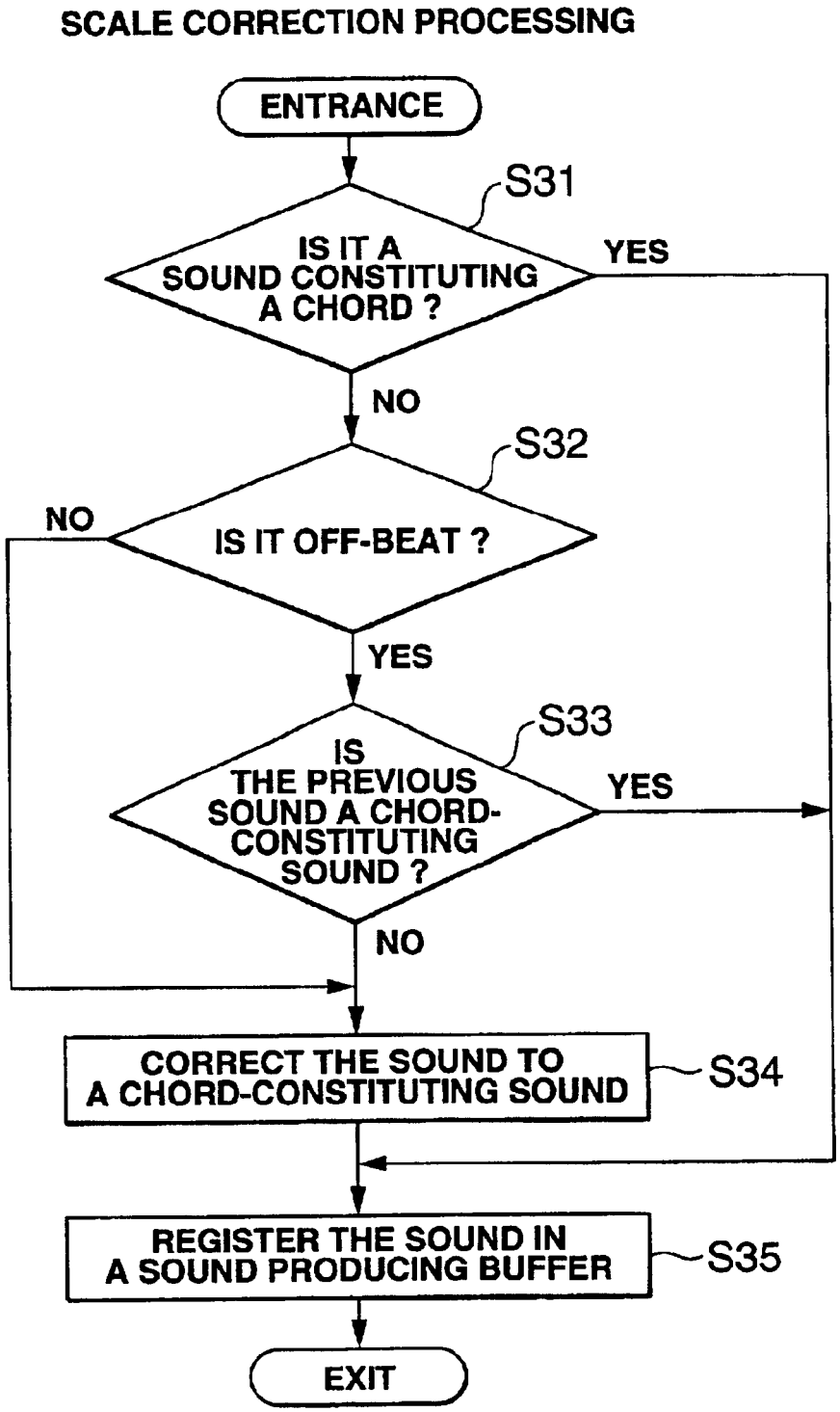
FIG. 4 is a flow chart describing a scale correction processing subroutine.

In this step, the melody parameter generator 24 determines whether the scale candidate which was provisionally decided in the above-described method is the scale that matches the music theories. If it does not match the music theories, the melody parameter generator 24 corrects the scale candidate to a scale of an appropriate frequency by referring to, for example, the key and chord of the accompaniment at the moment. FIG. 4 is a flow chart showing a subroutine of the scale correction processing steps. As shown in FIG. 4, if the scale candidate is a chord-constituting sound (S31; YES), there is no problem in producing the sound and, therefore, the sound is registered in a sound producing buffer (S35). If the scale candidate is not a chord-constituting sound (S31; NO), there is a problem in producing the sound as it is and, therefore, correction processing is conducted as follows. If the producing timing of the scale candidate is on-beat (S32; NO), the melody parameter generator 24 corrects the scale candidate to a sound constituting a chord of which frequency is closest to the scale candidate (S34) and registers the sound in the sound producing buffer (S35). If the producing timing of the scale candidate is off-beat (S32; YES), the melody parameter generator 24 checks whether the previous sound was a chord-constituting sound (S33). If the previous sound was not a chord-constituting sound (S33; NO), the melody parameter generator 24 corrects the scale candidate to a sound constituting a chord of which frequency is closest to the most appropriate note (S34) and registers the sound in the sound producing buffer (S35). If the previous sound was a chord-constituting sound (S33; YES), the sound is registered in the sound producing buffer (S35).

Sound Production Starting Timing Deciding Step (S23)

In this step, the melody parameter generator 24 decides on the time for producing a melody. As a method of deciding on the starting timing for producing the melody, there are two methods: a method of conducting sound producing processing when the player operates the keys on the control pad 10 (direct sound producing processing); and a method of conducting sound producing processing after adjusting the sound producing time in accordance with the accompaniment progress timing (sound production starting timing adjustment processing). In the method of the direct sound producing processing, the key operations by the player coincide with the sound producing timing and, therefore, the player can enjoy the feeling as if he/she is playing a real musical instrument.

Figure 10:
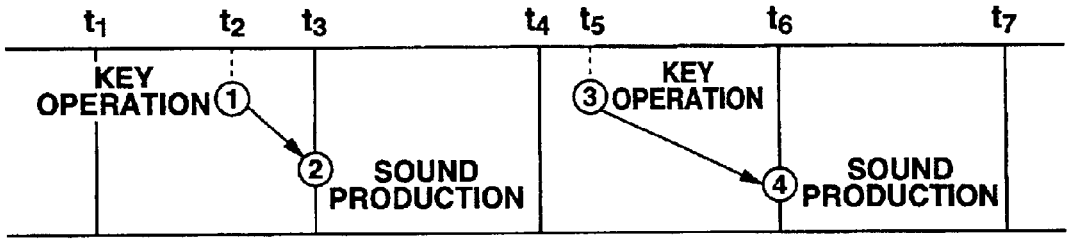
FIG. 10 is an explanatory drawing illustrative of melody sound producing timing.

FIG. 10 is an explanatory drawing illustrative of the sound production starting time adjustment processing. In FIG. 10, times $t_1$, $t_3$, $t_4$, $t_6$ and $t_7$ are the sound producing timings of the melody in synchronization with the accompaniment, and the timings are determined on the basis of processing units such as a quarter note, a eighth note and a sixteenth note. The sound producing processing of the melody in response to the key operation as inputted on the time $t_2$ is not conducted at that moment, but a delay time ($t_3$–$t_2$) is set so that the sound producing processing is suspended until the time $t_3$ which is the closest sound producing timing. Similarly, the sound producing processing of the melody in response to the key operation as inputted on the time $t_5$ is not conducted at that moment, but a delay time ($t_6$–$t_5$) is set so that the sound producing processing is suspended until the time $t_6$ which is the closest melody sound producing timing. Accordingly, instead of conducting the sound production at the time of the key operation, the starting time for producing the melody is set in order to produce the melody sound on the sound producing timings that are predetermined for each accompaniment. Therefore, the player can freely compose music while enjoying the game play without being forced to input any complicated operations.

Note Length Deciding Step (S24)

In this step, the melody parameter generator 24 decides on note lengths of the notes in the melody. Examples of the method for deciding the note lengths include: a method of terminating the sound producing processing upon the next key operation; and a method of terminating the sound producing processing when a bar, in which the melody presently produced is included is finished, or on any corresponding musical timing. When a sound of low continuity is used, it is not always necessary to decide on the note lengths.

BGM Reproduction Processing Step (S14)

In this step, the sound processor 26 conducts the BGM reproduction processing on the basis of the melody parameter supplied from the melody parameter generator 24, the accompaniment parameter supplied from the accompaniment parameter generator 25, and the sound producing factor and its sound producing processing unit supplied from the sound producing timing adjuster 27. The sound producing timing of the melody is adjusted by the sound producing timing adjuster 27 in order to synchronize with the accompaniment progress timing. The sound producing timing adjuster 27 comprises a buffer memory 28 and receives the operational signals, i.e., the sound producing factor, inputted by the player with the control pad 10, and writes the sound producing processing unit corresponding to the sound producing factor in the buffer memory 28. The sound producing processing unit is determined by units such as a fourth note, eighth note, or a sixteenth note.

Figures 5, 6:
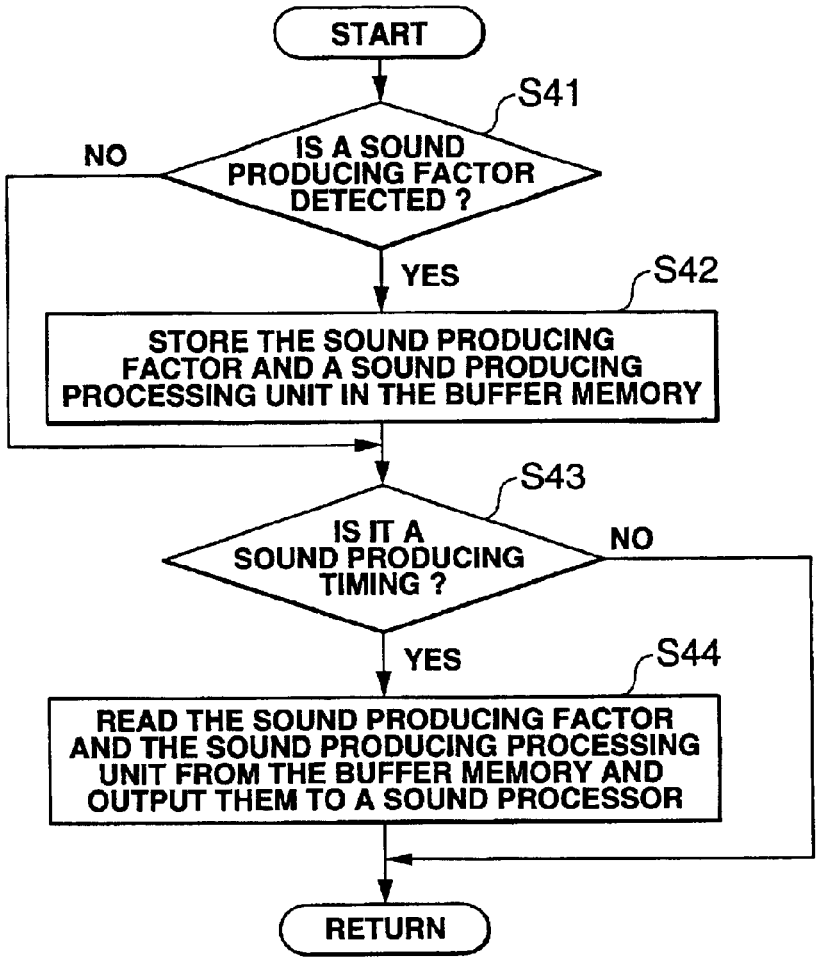
FIG. 5 is a flow chart describing the step of adjusting a sound producing timing for a sound producing factor.
FIG. 6 shows sound producing factors which cause melody generation, and sound processing units.

FIG. 5 is a flow chart indicating the processing steps of adjusting the sound producing timing of the melody. Each processing step in FIG. 5 is conducted repeatedly in synchronization with an image renewal period (for example, 1/60second). The sound producing timing adjuster 27 detects the sound producing factor supplied from the control pad 10 (S41; YES), and writes the type of the sound producing factor and the sound producing processing unit in the buffer memory 28 (S42). The data written in the buffer memory 28 is as shown in FIG. 6. As shown in FIG. 6, a processing unit of an eighth note is allotted to the key input of the button A 11, and a processing unit of an eighth note is allotted to the key input of the button B 12. A processing unit of a quarter note is allotted to the key input of the button X 13 and a processing unit of a quarter note is allotted to the key input of the button Y 14.

The sound producing timing adjuster 27 acquires information about the melody sound producing timing supplied from the accompaniment parameter generator 25. Upon the sound producing timing (S43; YES), the sound producing timing adjuster 27 reads the sound producing factor and the sound producing processing unit from the buffer memory 28 and outputs them to the sound processor 26 (S44). The data supplied to the sound processor 26 is then deleted from the buffer memory 28.

Through the above-described steps, the sound processor 26 generates BGM.

In the above explanation, in the melody parameter generating step (S13), the scale, the sound production starting time, and the note lengths are decided. In addition, for example, sound quality control, volume control, tone color control, and generation of sub-melody maybe added to the melody parameters. The control of the sound quality is conducted, for example, by employing: heavy sound quality when the player's character moves agilely; soft sound quality when the player's character moves slowly; cheerful sound quality when the player's character enters a bright area; sound quality with subtly changing pitches when the player's character spins around; or sound quality that changes in accordance with the sound quality of the accompaniment. Thus, the sound quality changes in accordance with the sound quality of the accompaniment.

The volume control is performed, for example, in the following manner: by turning up the volume when the player's character moves around vigorously; by turning down the volume when the player's character moves slowly; by turning up the volume when a game score is increased; or adjusting the volume in accordance with the volume of the accompaniment. The control of the tone color is conducted, for example, in the following manner: by changing musical instruments (such as a piano, a guitar, and a violin) when a stage changes; by changing the musical instrument when the player's character is changed; or by changing the musical instrument when the power of the player's character is increased. The generation processing of the sub-melody is conducted such that when the game enters into a special state such as a last stage, a sub-melody of a 3-degree (or 5-degree) higher (or lower) scale is reproduced over the melody.

Such structure may be employed that the melody generated in the above-described processing steps is stored in the memory and is reproduced without requiring the operations by the player. For example, the melody generated when the moving block 61 is moved to the right or left is stored in the memory and is reproduced when the moving block 61 falls down in the virtual space 63 or when a score is added by matching the projections and depressions of the accumulated block 62 with the projection and depression of the moving block of 61.

As explained above, in this embodiment, the player performs the usual game operations without paying much attention to the fact that "the music is generated by his/her operations," while BGM which conforms to the status of the game can be automatically generated by easy key operations. The above explanation describes the case in which the BGM for the game is generated by the player's operations. However, without limitation to such form, the present invention can also be employed as a form of a music game to compete for superiority of music compositions which are generated, or as a form of musical instrument to easily arrange a melody or an accompaniment of existing music compositions, or as a form of session among a multiplicity of persons via a communication network such as a telephone line, or as a form of a composing tool for the purpose of easily generating a music composition as intended by a user.

Figure 11:
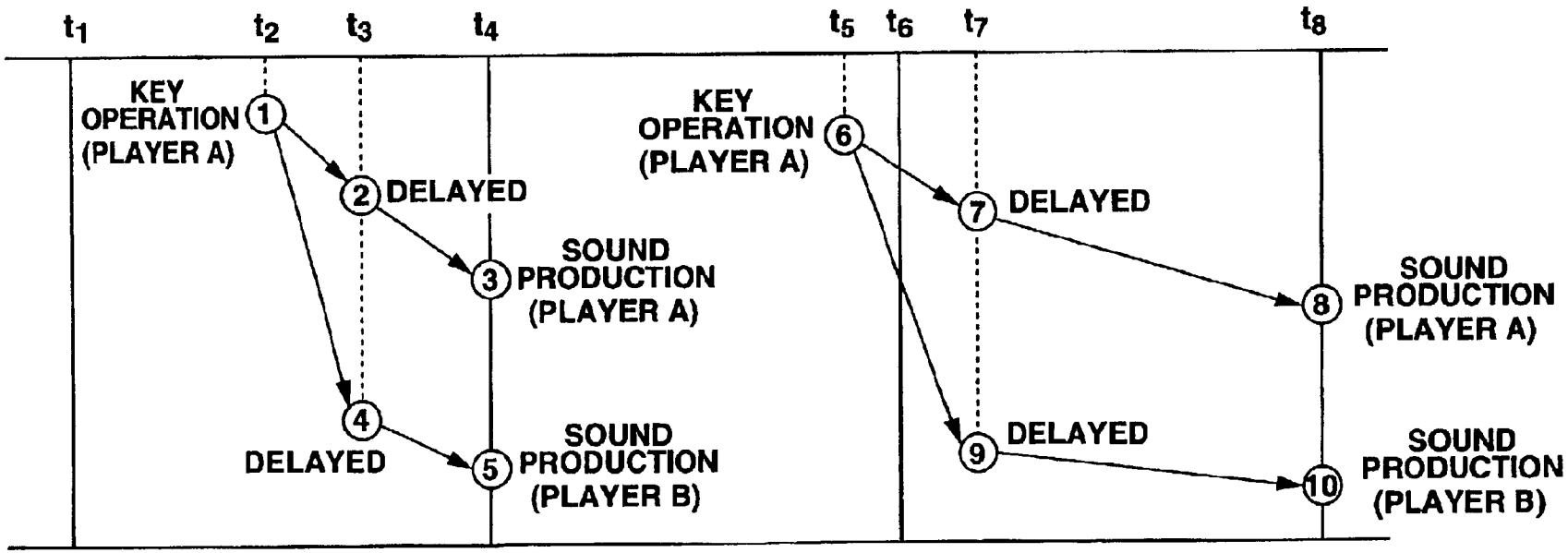
FIG. 11 is an explanatory drawing illustrative of melody sound producing timing.

The form of performing a session among a multiplicity of persons via the communication network is hereinafter explained with reference to FIG. 11. The precondition is that a player A and a player B at their homes connect their game devices to the telephone line via modems in order to perform a session via the network. In FIG. 11, times $t_1$, $t_4$, $t_6$ and $t_8$ are the melody sound producing timings. When a game is generally played via the network, it is usually necessary to take in to consideration the delay time (time lag) of signals. Accordingly, each game device buffers the signals from the other game device and reads the signals from the buffer after a specified period of time, thereby conducting the game processing. When this delay time is set as T [msec], the operational signal from the player is processed at each game device after the delay time T [msec].

The key operation inputted at time $t_2$ is processed as operational signals by the game devices of the players A and B at time $t_3$ after a lapse of the delay time T [msec]. The signals are made between time $t_1$ and time $t_4$, and the sound producing processing is conducted at the sites of the respective players at time $t_4$. On the other hand, when the game device is not connected to the network, but is used as a stand-alone game device, the key operation at time $t_2$ is subject to the sound producing processing at time $t_4$. Accordingly, in this embodiment, a melody in response to the key operation is produced on the melody sound producing timing which is determined. The production of the melody is conducted without depending on the delay time which is peculiar to network game play.

However, when the input time of the key operation is within T [msec] of the sound producing timing, the production of the melody is conducted depending on the delay time. For example, assuming that the player A operates the key at time $t_5$, in the case of $(t_6-t_5)<T$ [msec], the key operation inputted at time $t_5$ is processed as the operational signals of the key operation by the game devices of the players A and B at time $t_7$ after a lapse of T [msec]. Since these signals are made between time $t_6$ to time $t_8$ the sound producing processing is conducted at the sites of the respective players at time $t_8$. However, the delay time T [msec] is small enough to be ignored as compared with the intervals of the sound producing timings and, therefore, the production of the melody is conducted without depending on the delay time which is peculiar to the network game play.

The above description-explains, as an example, the key operation by the player as the sound producing factor which becomes a cause of melody production. However, there is no special limitation to the sound producing factor as long as is occurs discretely in a certain period of time and is of various types. For example, the sound producing factor may be defined according to the status of the game, for example, when the game proceeds advantageously for the player, when the game proceeds disadvantageously to the player, when a good thing happens to the player, when the game progress becomes monotonous, when the player operates the keys frequently, when a certain series of game scenes are completed, or when the player moves to scenes requiring complicated operations.

Furthermore, for example, in a role-playing game or a competition game, the sound producing factor may be defined according to the status of the game or the movements of the player's character as follows: when the player's character enters a bright stage; when it moves to a dark stage; when it is surrounded by enemy characters; when it escapes from a siege by the enemy characters; when it enters a narrow area; when it enters a wide area; when it stands up; when it changes its moving direction; when it jumps; when it suffers injuries; when it wins an item; when it uses the item; when it moves vigorously; when it moves slowly; when it spins around; when it makes small movements; when it makes large movements; or when it falls down.

It is also possible to set tones beforehand for different types of the sound producing factors. For example, the tone "do" is set for the case in which the player's character stands up, the tone "re" is set for the case in which the player's character changes its moving direction, the tone "mi" is set for the case in which the player's character jumps. The sound producing factor of the melody may also be defined depending on the parameters, that are changed or renewed as necessary, in accordance with the progress of the game, such as the brightness of the game screen, the number of the enemy characters, and the scores obtained by the player.

Moreover, output signals from the other devices connected to the game device, such as output signals from a sound input and output device and an image input and output device such as a digital camera and a scanner, may be defined as the sound producing factors. Furthermore, interruption signals from the peripheral devices for the game software (the peripheral devices such as standard devices and expansion devices) may be defined as the sound producing factor. Examples of the peripheral devices include, a standard game controller, a joy stick, a steering wheel, a keyboard, a mouse, a gun-shaped controller, a backup memory, a TV monitor, and a set top box. If such structure is employed, a melody is automatically generated in synchronization with the parameters, which are changed or renewed as necessary, in accordance with the progress of the game, the behaviors of various characters such as the player's character and the enemy characters, changes of the status of such characters, increases and decreases in the number of such characters, the number of items acquired, and the scores acquired.

In the accompaniment parameter generating step (S12) and the melody parameter generating step (S13), the melody parameter and the accompaniment parameter can be generated by conducting, for example, the following operations: by employing a cheerful or high-tempo melody or accompaniment when the game proceeds advantageously to the player; by employing a gloomy or slow-tempo melody or accompaniment when the game proceeds disadvantageously to the player; by employing a lively melody or accompaniment when a good thing happens to the player; by decreasing changes in the melody or accompaniment patterns when the game proceeds monotonously; by increasing the tempo of the melody or accompaniment when the player operates the keys frequently; by decreasing the tempo when a certain series of the game scenes are completed; by employing complicated melody or accompaniment patterns when the player moves to scenes requiring complicated operations.

The above description explains the case in which the BGM is automatically generated in response to the key operations by the player. However, without limitation to such method, it is possible to produce sound effects in synchronization with the sound producing timing of the BGM. The sound effects are the sounds that enhance the realistic feel of the game and the acoustic effects, for example, explosion sounds in a shooting game, shooting sounds of bullets, slipping sounds of tires in a racing game, engine sounds, collision sounds at crash, and ball-hitting sounds.

Figures 12, 13:
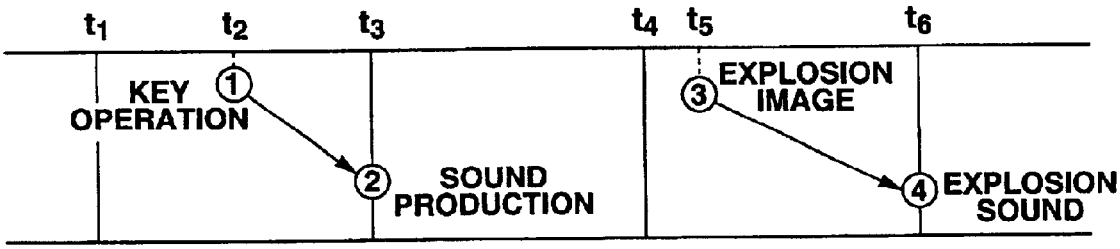
FIG. 12 is an explanatory drawing illustrative of sound effect producing timing.
FIG. 13 shows the sound producing factors which cause the generation of sound effects, and the sound producing processing units thereof.

The sound producing timing of the sound effects is explained with reference to FIG. 12. The method of adjusting the sound producing timing of the sound effects is similar to that of adjusting the starting time for producing the melody as described above. In FIG. 12, times $t_1$, $t_3$, $t_4$ and $t_6$ are the timings on which the sound effects should be produced in synchronization with the BGM. The times are determined by using, as the reference, the processing units such as a quarter note, an eighth note and a sixteenth note. Bullet shooting sounds and explosion sounds are taken as examples of the sound effects in a shooting game. The precondition is that the player's key input and the explosion processing are defined as the sound producing factors and that the bullet firing processing is conducted at the same time as the player's key operation. In FIG. 12, the player operated the keys at time $t_2$. In a usual game, the sound producing processing of the bullet firing sound is conducted at the same time as the key input, that is, at time $t_2$. In the present invention, however, the delay time ($t_3$–$t_2$) is set so that the sound effect is not produced at time $t_2$, but is retained until time $t_3$ which is the closest sound producing timing, and the sound is then produced.

In FIG. 12, the processing is conducted to display an explosion image at time $t_5$. In a usual game, the explosion sound is produced at the same time as the image of the explosion is displayed, that is, at time $t_5$. In the present invention, however, the delay time ($t_6$–$t_5$) is set so that the sound effect is not produced at time $t_5$, but is retained until time $t_6$ which is the closest sound producing timing, and the sound is then produced. Accordingly, the sound effect is not produced when the key input is conducted or when the explosion image is displayed, but a starting time for producing the sound effect is set so that the sound effect will be produced on the sound producing timing which is predetermined for all BGM. Therefore, the player can make a music composition while enjoying playing the game without being forced to input complicated operations.

In order to output the sound effect in synchronization with the BGM, the sound producing timing adjuster 27 receives, from the game processor 22, the sound producing factors such as the key input and the explosion processing, writes the sound processing unit corresponding to the sound producing factor in the buffer memory 28, and supplies the data to the sound processor 26 in synchronization with the output timing of the sound effect. The basic processing steps are as shown in FIG. 5. The data to be written in the buffer memory 28 is as shown in FIG. 13. As shown in FIG. 13, the processing unit of an eighth note is allotted to the key input of the button A 11 and to the key input of the button B 12 respectively. The processing unit of a sixteenth note is allotted to explosion processing A and to explosion processing B respectively. Accordingly, the sound processor 26 can output the sound effect in synchronization with the BGM.

The terms "processor(s)," "generator(s)," "adjuster(s)" and "means" used in this specification indicate the modules that are realized in the automatic music composition generating processing or the BGM generating processing and do not necessarily correspond to specific hardware or software routines. The same hardware element sometimes realizes a plurality of "processors," "generators," "adjusters" or "means", while one "processor," "generator," "adjuster" or "means" is sometimes realized in relation to a plurality of hardware elements.

The present invention can provide a technique to easily compose the BGM without requiring the complicated operations of the player. This invention can also provide a technique to implement a harmonized sound environment by adjusting the output timing of the audio signals such as sound effects, in synchronization with the BGM.

What is claimed is:

1. A computer program product having a computer readable storage medium storing a computer program for causing a computer system to execute a processing to generate an audio signal, wherein the computer program performs the steps of:

performing the processing of a game in accordance with an input by a player;

outputting background music;

detecting an occurrence of an event accompanied by a sound;

delaying a timing of the output of the sound so that the background music, which is outputted at the time the occurrence of the event is detected, and the sound corresponding to the event are synchronized; and after delaying the timing, outputting the sound corresponding to the event.

2. The computer program product according to claim 1, wherein the sound is a sound effect generated within the game processing.

3. A method for outputting an audio signal, comprising the steps of:

outputting background music;

detecting an occurrence of an event accompanied by sound;

delaying a timing of the output of the sound so that the background music, which is outputted at the time the occurrence of the event is detected, and sound corresponding to the event are synchronized; and after delaying the timing, outputting the sound corresponding to the event.

4. The method for outputting the audio signal according to claim 3, wherein the sound is a sound effect generated within the game processing.

5. A game device, comprising:

means for outputting background music;

means for performing a processing of a game in accordance with an input by a player;

means for detecting an occurrence of an event accompanied by a sound;

means for delaying a timing of the output of the sound so that background music, which is outputted at the time the occurrence of the event is detected, and the sound corresponding to the event are synchronized; and means for after delaying the timing, outputting the sound corresponding to the event.

6. A computer program product having a computer readable storage medium storing a computer program for causing a computer system to execute a processing to generate an audio signal, wherein the computer program performs the steps of:

performing the processing of a game in accordance with an input by a player;

outputting an accompaniment corresponding to a status of a game;

detecting an occurrence of an event accompanied by a melody;

delaying the timing of the output of the melody so that a progression of an accompaniment, which is outputted at the time the detection of the occurrence of the event is detected, and the output of the melody corresponding to the event are synchronized; and after delaying the timing, outputting the melody corresponding to the event.

7. The computer program product according to claim 6, wherein the progression of the accompaniment includes information on timing of the generation of the melody which is predetermined for every accompaniment.

8. The computer program product according to claim 6, wherein the computer program further includes deciding a scale in the melody that corresponds to a type of event.

9. A method for outputting a sound signal, comprising the steps of:

performing a processing of a game in accordance with an input by a player;

outputting an accompaniment corresponding to the status of the game;

detecting an occurrence of an event accompanied by a melody;

delaying the timing of the output of the melody so that a progression of the accompaniment, which is outputted at the time the detection of the occurrence of the event is detected, and the output of the melody corresponding to the event are synchronized; and after delaying the timing, outputting the melody corresponding to the event.

10. The method for outputting a sound signal according to claim 9, wherein the progression of the accompaniment includes information on timing of the generation of the melody which is predetermined for every accompaniment.

11. A method for outputting a sound signal according to claim 9, further comprising deciding a scale in the melody that corresponds to a type of event.

12. A game device comprising:

means for performing a processing of a game in accordance with an input by a player;

means for outputting an accompaniment corresponding to a status of the game;

means for detecting an occurrence of an event accompanied by a melody;

means for delaying a timing of the output of the melody so that a progression of the accompaniment, which is outputted at the time the detection of the occurrence of the event is detected, and the output of the melody corresponding to the event are synchronized; and means for after delaying the timing, outputting the melody corresponding to the event.

* * * * *